US005612706A

United States Patent [19]

Podell

[11] Patent Number: 5,612,706

[45] Date of Patent: Mar. 18, 1997

[54] DUAL-ARRAY YAGI ANTENNA

[75] Inventor: Allen F. Podell, Palo Alto, Calif.

[73] Assignee: Pacific Monolithics, Inc., Sunnyvale, Calif.

[21] Appl. No.: 566,279

[22] Filed: Dec. 1, 1995

Related U.S. Application Data

[63] Continuation of Ser. No. 235,490, Apr. 29, 1994, abandoned.

[51] Int. Cl.[6] ..... H01Q 19/30

[52] U.S. Cl. ..... 343/818; 343/817; 343/819

[58] Field of Search ..... 343/818, 810, 343/812, 813, 815, 817, 819; H01Q 19/30, 19/10

[56] References Cited

U.S. PATENT DOCUMENTS

| | | | |
|---|---|---|---|
| 2,726,390 | 12/1955 | Weiss | 343/815 |
| 2,897,497 | 7/1959 | Finneburgh, Jr. | 343/819 |
| 3,096,520 | 7/1963 | Ehrenspeck | 343/819 |
| 3,159,839 | 12/1964 | Hings | 343/819 |
| 3,214,760 | 10/1965 | Yonkers | 343/818 |
| 3,218,645 | 8/1965 | Ehrenspeck | 343/819 |
| 3,329,960 | 7/1967 | Winegard | 343/819 |
| 3,573,841 | 4/1971 | Greenberg | 343/815 |
| 3,653,056 | 3/1972 | Peterson | 343/795 |
| 3,683,391 | 8/1972 | Callaghan | 343/815 |
| 4,114,163 | 9/1978 | Borowick | 343/818 |
| 4,121,215 | 10/1978 | Barbano | 343/818 |
| 4,604,628 | 8/1986 | Cox | 343/818 |
| 5,061,944 | 10/1991 | Powers et al. | 343/818 |

*Primary Examiner*—Hoanganh T. Le
*Attorney, Agent, or Firm*—Edward B. Anderson

[57] ABSTRACT

A driven element is disposed on an antenna axis for transmission of electromagnetic energy in a transmission direction along the antenna axis. First and second parasitic arrays are disposed on opposite sides of the antenna axis in the transmission direction from the driven element. At least a portion of the antenna axis adjacent to the parasitic arrays is without parasitic elements. Each parasitic array has a plurality of parallel parasitic elements or directors spaced apart along a respective array line that includes a proximal portion adjacent to the driven element that extends in a general direction that is at an acute angle to the transmission direction. The first and second parasitic arrays are sufficiently close to the antenna axis to produce a radiation pattern that has a lobe with greatest magnitude in the transmission direction.

10 Claims, 2 Drawing Sheets

Fig. 4
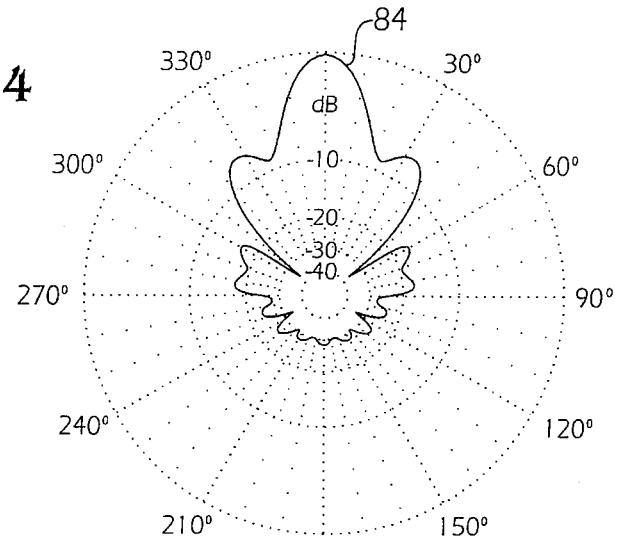
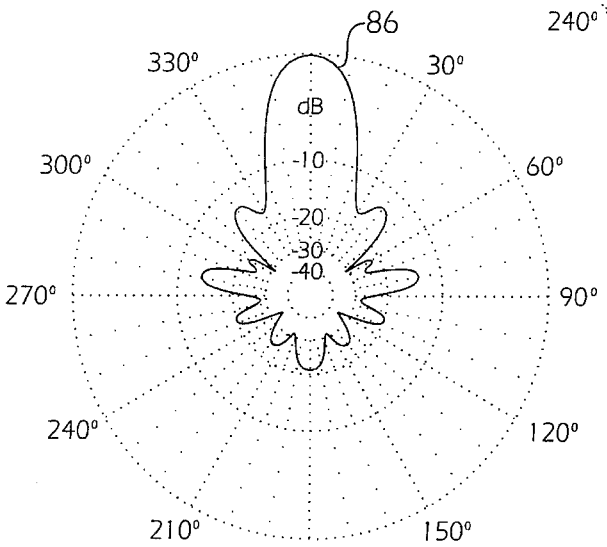
Fig. 5
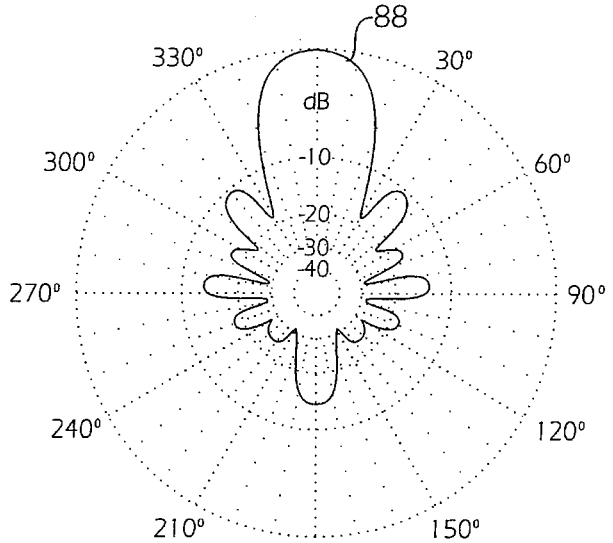
Fig. 6

DUAL-ARRAY YAGI ANTENNA

This application claims the benefit of and is a continuation of U.S. application Ser. No. 08/235,490 filed on Apr. 29, 1994, now abandoned.

BACKGROUND OF THE INVENTION

1. Field of the Invention

This invention relates to Yagi antennas, and more particularly, to Yagi antennas having a pair of opposed linear arrays of parallel parasitic elements.

2. Related Art

Yagi antennas are used for various high-frequency applications such as the reception of television signals, point-to-point communications, and certain types of military communications. They are becoming increasingly used for what is commonly referred to as wireless or cableless television transmission by which numerous signals are transmitted over a design frequency band.

A basic Yagi antenna has a single driven element, usually a half-wave dipole, which is driven from a source of, or which drives a sink of electromagnetic energy. Arrayed with the dipole are certain non-driven or parasitic elements. These typically include a reflector element on one side of the dipole and one or more director elements on the other side of the dipole.

All of these elements are typically positioned along an antenna axis with the director elements extending in what is referred to herein as the transmission direction from the dipole. The transmission direction is that direction to which electromagnetic energy is to be transmitted, or from which signal energy is to be received.

It is known to use parasitic elements in other configurations. For instance, placement of a sleeve around the dipole or elements on each side of and parallel to the dipole provides an antenna having a satisfactory gain or directivity over a relatively broad frequency range, as is stated in U.S. Pat. No. 5,061,944. This arrangement of parasitic elements appears to allow the array of directors on the antenna axis to be about 25% shorter than would otherwise be required.

It is also known to provide parasitic arrays parallel to and adjacent to the distal end of the main array on the antenna axis to improve the directivity of the antenna, as is disclosed in U.S. Pat. No. 3,218,645. The described antenna is said to provide an increase in gain of 60%, which is equivalent to a decrease in length of about 38% compared to a standard Yagi antenna for the same gain.

While this known art is effective in increasing the gain or decreasing the length for a given gain of a Yagi antenna, it is further desirable to have even shorter antennas for the same gain. It is yet further desirable to have an antenna that is relatively inexpensive and simple to manufacture.

SUMMARY OF THE INVENTION

These features are provided in the present invention by a Yagi antenna having a pair of initially diverging director arrays. More particularly, an antenna made according to the present invention includes a driven element disposed on the antenna axis for transmission of electromagnetic energy in a transmission direction along the antenna axis. First and second parasitic arrays are disposed on opposite sides of the antenna axis in the transmission direction from the driven element. Each parasitic array has a plurality of parallel parasitic elements spaced apart along a respective array line that includes a proximal portion adjacent to the driven element that extends in a general direction that is at an acute angle to the transmission direction. The first and second parasitic arrays are sufficiently close to the antenna axis to produce a radiation pattern that has a lobe with greatest magnitude in the transmission direction.

Each of the first and second parasitic arrays preferably has a distal portion that extends in a general direction that is within five degrees of the transmission direction. Parasitic elements on an intermediate portion of the antenna axis do not contribute to the gain of the antenna, and therefore preferably are not provided.

It is found that the first and second arrays are about half the length of a conventional array with a single parasitic array along the antenna axis. The antenna of the present invention is thus significantly more compact than a conventional array. Also, because the support structure for the two arrays may be connected, the antenna assembly is more stable than a conventional single, axial array Yagi antenna, particularly one of equivalent gain. Further, the two arrays are preferably identical, being mirror images of each other in the array. Thus, the two arrays are provided by identical structures, making the antenna relatively inexpensive as well as simple to construct.

These and other features and advantages of the present invention will be apparent from the preferred embodiment described in the following detailed description and illustrated in the accompanying drawings.

BRIEF DESCRIPTION OF THE DRAWINGS

FIG. 4 is an elevational view of the beam pattern obtainable with a first alternative embodiment shown in FIG. 3.

FIG. 5 is an elevational view of the beam pattern obtainable with the antenna of FIG. 1.

FIG. 6 is an elevational view of the beam pattern obtainable with a second alternative embodiment shown in FIG. 3.

DETAILED DESCRIPTION OF THE PREFERRED EMBODIMENT

Figure 1:
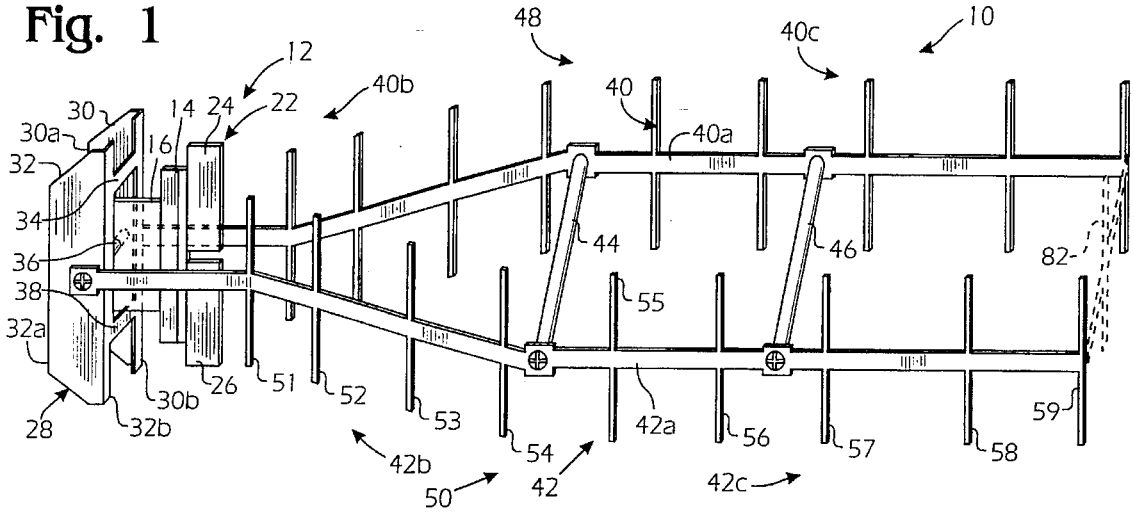
FIG. 1 is an isometric view of an antenna made according to the invention.
Figure 2:
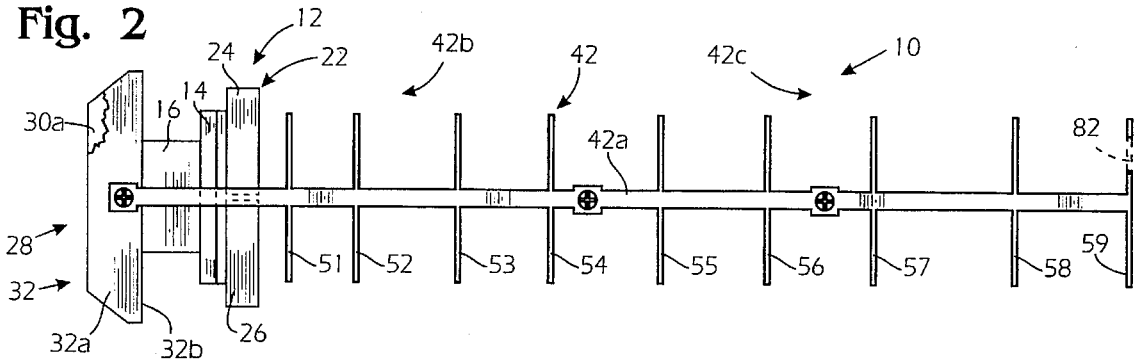
FIG. 2 is a side view of the antenna of FIG. 1.
Figure 3:
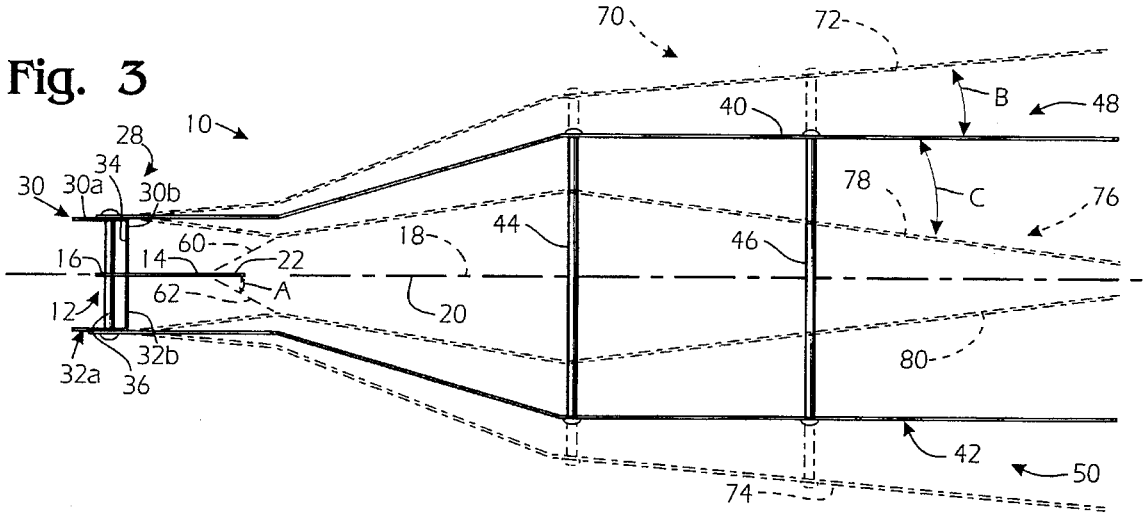
FIG. 3 is a top view of the antenna of FIG. 2, with alternative embodiments illustrated.

Referring initially to FIGS. 1–3, an antenna 10 made according to the invention is shown. Antenna 10 includes a driven-element assembly 12, including a driven element in the form of a half-wave dipole 14 fabricated on an insulating and supporting mounting board 16 using conventional techniques. The dipole is positioned for transmitting or receiving electromagnetic radiation at a design frequency along an antenna axis 18. For a design frequency of 2600-MHz, dipole 14 is 2-inches (5.1-cm) long by 0.2-inches (0.5-cm) wide.

Ahead of dipole 14 in a transmission direction represented by arrow 20 along axis 18 is a split director 22. This director includes what in effect are two collinear, spaced-apart side elements 24 and 26. The side elements are spaced 0.06-inches (1.5-mm) apart, and are 1.25-inches (3.2-cm) long by 0.5-inches (1.3-cm) wide.

Behind dipole 14 is a base 28 formed by side members 30 and 32 connected by brace arms 34, 36 and 38. As viewed in FIG. 3, the side members have a general L-shape, with there being a main side portion **30*a* and 32*a*, and a narrow reflector portion 30***b* and 32*b*. The reflector portions, which function as reflectors for dipole 14, are 3-inches (7.6-cm) long. These two reflector portions are 1-inch (2.5-cm) apart.

Mounted to and extending generally in the transmission direction beside axis 18 are two parasitic array structures 40 and 42. Structures 40 and 42 are spaced from axis 18 and include respective support members 40*a* and 42*a*. The support members are mounted at one end to the centers of the sides of respective base side members 30 and 32. Support members 40*a* and 42*a* are connected together with supporting spacers 44 and 46 at spaced positions as shown.

Distributed along support members 40*a* and 42*a* in parallel relationship are cross members that function as parasitic directors represented collectively as parasitic arrays 48 and 50. The parasitic arrays are preferably mirror images of each other about a plane paralleling the parasitic directors and containing the antenna axis. The arrays have nine directors. Specifically, array 50 includes nine directors 51–59. The length and spacing of these directors is determined according to conventional Yagi antenna design relative for a selected design frequency.

It is noted that the array directors are all disposed along the antenna axis in the transmission direction from the dipole beyond the position of split director 22. The lines of the-directors, represented initially by dash-double-dot lines 60 and 62, and as represented in part by support members 40*a* and 42*a*, follows a path that includes proximal portions 40*b* and 42*b* and distal portions 40*c* and 42*c*. The proximal portions diverge from dipole 14 at acute angles in the transmission direction, as represented by an initial, maximum angle A. Angle A is preferably about 30° relative to transmission direction 20.

In the preferred embodiment, shown in solid lines in FIG. 3, the distal portions 40*c* and 42*c* include several elements positioned in a straight line that is parallel to antenna axis 18.

A first alternative embodiment is shown as antenna 70 having arrays 72 and 74 with distal portions 72*a* and 74*a* extending in a line that is at an angle B of approximately 5°. Both of these arrays thus diverge from axis 18 along their entire length.

A second alternative embodiment is shown as antenna 76 having arrays 78 and 80. Although these arrays initially diverge in the proximal portions 78*a* and 80*a* adjacent to the dipole, the distal portions 78*b* and 80*b* converge toward axis 18, also at an angle C of about 5°.

Antennas 10, 70 and 76 may also include one or more on-axis parasitic elements, such as element 82 shown in dashed lines in FIG. 1. Element 82 is positioned between the end elements of the respective arrays. It is found that such an element or elements at the distal ends of the arrays improve gain slightly, in the order of 0.1-dB, although it is more costly to make. On-axis parasitic elements between director 22 and element 82 do not improve the directivity or gain of the antenna as much as element 82 does.

Ideally, the parasitic arrays in the various embodiments would be positioned along curved lines. However, the arrays are made with the distal portion in a straight line for ease of manufacture.

Beam or radiation patterns for the three embodiments shown in FIG. 3 are given in FIGS. 4–6. In particular, pattern 84 shown in FIG. 4 (0dB=15.32 dBi) represents the pattern of antenna 70 having arrays with diverging distal ends. It is seen that the forward beam has wing lobes that broaden it, giving it less directivity. The forward beam does however have its maximum magnitude on the beam axis, as represented by the 0° radial.

This on-axis maximum exists with these arrays up to a maximum angle, represented by angle A,of about 30°. Beyond this angle, the separate lobes produced by each side array begin to separate, reducing gain on the antenna axis. Below 30° the individual array lobes overlap sufficiently to produce the on-axis maximum, but the interaction between the individual arrays is increased, with a resulting reduction in gain. The back lobes on pattern 84 are seen to be very small. Thirty degrees is therefore also a practical limit for angle B, although better directivity results for angles less than ten degrees.

Pattern 86 shown in FIG. 5 (0 dB=15.57 dBi) represents the pattern produced by antenna 10 in which the distal ends of arrays 40 and 42 are parallel to the antenna axis. This pattern has a pronounced single lobe along the antenna axis, with all other lobes being relatively limited.

FIG. 6 illustrates pattern 88 (0 dB=15.02 dBi) which corresponds with antenna 76 having arrays with distal ends converging on the antenna axis. Although this antenna still shows acceptable gain and directivity, it is seen that the back lobe is significantly increased in size.

It is thus apparent that variations in form and detail may be made in the preferred embodiment without varying from the spirit and scope of the invention as defined in the claims and any modification of the claim language or meaning as provided under the doctrine of equivalents. For instance, the array angles can be varied over a substantial range and still produce a single on-axis front lobe. Clearly the number of parasitic elements on each array and the spacing of the elements can also be varied. One could also have more on-axis elements, but these contribute much less gain per element added than do elements added to the two side arrays. With the preferred embodiment it is found that the on-axis elements contribute less than half as much gain as an element on the side arrays. For instance, element 82 contributes about 0.15 dB gain increase compared to about 0.45 dB gain increase for element 59. The preferred embodiment is thus provided for purposes of explanation and illustration, but not limitation.

I claim:

1. An antenna for transmitting or receiving electromagnetic energy along an antenna axis, said antenna comprising:

a driven element disposed on the antenna axis for transmission of electromagnetic energy in a transmission direction along the antenna axis; and first and second parasitic arrays disposed on opposite sides of the antenna axis in the transmission direction from said driven element and at least partially along a portion of the antenna axis along which parasitic elements each contribute less than half as much to the antenna directivity as does a corresponding element on one of the first and second parasitic arrays, each parasitic array having a plurality of parallel parasitic directors spaced apart along respective array lines that extend in a general direction from the driven element at a first acute angle to the transmission direction, which array lines extend, along the length of the array lines, at a maximum angle that is less than the first angle and not greater than thirty degrees, whereby the first and second parasitic arrays have a collective radiation pattern that has a lobe with greatest magnitude in the transmission direction.

2. An antenna according to claim 1 wherein the first and second parasitic array lines diverge from the antenna axis along their lengths.

3. An antenna according to claim 1 wherein each of the first and second parasitic arrays includes a distal portion that extends at an angle of less than ten degrees relative to the antenna axis.

4. An antenna according to claim 1 wherein each of the first and second parasitic arrays includes a distal portion that extends parallel to the antenna axis.

5. An antenna according to claim 1 wherein each of the first and second parasitic arrays includes a distal portion that converges toward the antenna axis.

6. An antenna according to claim 1 wherein the line of the antenna array includes a proximal portion that extends at the first angle and a distal portion that extends at a second angle less than the first angle.

7. An antenna according to claim 6 wherein the second angle is less than ten degrees.

8. A Yagi antenna for transmitting or receiving electromagnetic energy along an antenna axis, said antenna comprising:

a driven element disposed on the antenna axis for transmission of electromagnetic energy in a transmission direction along the antenna axis;

a first director parallel to said driven element and disposed adjacent to said driven element on the antenna axis in the transmission direction from said driven element, first and second parasitic arrays disposed on opposite sides of the antenna axis in the transmission direction from said first director, at least a portion of said first and second parasitic arrays being disposed along a portion of the antenna axis without on-axis parasitic elements, each parasitic array having a plurality of parallel parasitic directors spaced apart along respective array lines that extend in a general direction that includes a proximal portion adjacent to said first director that extends from said driven element at a first angle that is not greater than thirty degrees to the transmission direction, and a distal portion that extends at a angle that is less than the first angle and is less than ten degrees to the transmission direction, whereby said first and second parasitic arrays have a collective radiation pattern that has a lobe with greatest magnitude in the transmission direction.

9. An antenna according to claim 8 further comprising a second director also parallel to said driven element and disposed between the distal portions of said first and second arrays on the antenna axis.

10. An antenna for transmitting or receiving electromagnetic energy along an antenna axis, said antenna comprising:

a driven element disposed on the antenna axis for transmission of electromagnetic energy in a transmission direction along the antenna axis; and first and second parasitic arrays disposed on opposite sides of the antenna axis in the transmission direction from said driven element and at least partially along a portion of the antenna axis along which parasitic elements each contribute less than half as much to the antenna directivity as does a corresponding element on one of the first and second parasitic arrays, each parasitic array having a plurality of parallel parasitic directors spaced apart along respective array lines and including a distal portion that extends at an angle that is less than ten degrees relative to the antenna axis, whereby the first and second parasitic arrays have a collective radiation pattern that has a lobe with greatest magnitude in the transmission direction.

* * * * *